US007729501B2

(12) United States Patent
Hasler

(10) Patent No.: US 7,729,501 B2
(45) Date of Patent: Jun. 1, 2010

(54) HEARING DEVICE WITH ANTI-THEFT PROTECTION

(75) Inventor: Ivo Hasler, Winterthur (CH)

(73) Assignee: Phonak AG, Stafa (CH)

( * ) Notice: Subject to any disclaimer, the term of this patent is extended or adjusted under 35 U.S.C. 154(b) by 1387 days.

(21) Appl. No.: 11/101,722

(22) Filed: Apr. 8, 2005

(65) Prior Publication Data

US 2006/0227987 A1 Oct. 12, 2006

(51) Int. Cl.
*H04R 25/00* (2006.01)

(52) U.S. Cl. ..... 381/314; 381/312

(58) Field of Classification Search ..... 381/312
See application file for complete search history.

(56) References Cited

U.S. PATENT DOCUMENTS

2001/0055404 A1 12/2001 Bisgaard
2004/0081328 A1* 4/2004 Leedom et al. ..... 381/312
2005/0254675 A1* 11/2005 Sacha ..... 381/312
2007/0296589 A1* 12/2007 Cullum ..... 340/572.1

FOREIGN PATENT DOCUMENTS

DE 199 16 900 C1 9/2000
EP 1 363 473 A2 11/2003

* cited by examiner

*Primary Examiner*—Walter F Briney, III
(74) *Attorney, Agent, or Firm*—Pearne & Gordon LLP

(57) ABSTRACT

The present invention thus provides a hearing device with at least one programmable signal processing unit for the temporary or permanent activation or deactivation of features of the hearing device, comprising at least one counter for the logging of discrete actions and at least one stored threshold value related to at least one specific type of said actions, the counter being connected to said signal processing unit for activating or deactivating a feature of said signal processing unit when reaching or passing said threshold value. As long as the threshold value is not reached by the counter, the hearing device will have its originally predetermined functionality or programmed features without any further limitations. If the counter reaches or passes its threshold value, an action will be triggered by the counter directed to the signal processing unit causing any predefined reaction of the hearing device.

18 Claims, 1 Drawing Sheet

HEARING DEVICE WITH ANTI-THEFT PROTECTION

This invention relates to a hearing device with at least one programmable signal processing unit for the temporary or permanent activation or deactivation of features of the hearing device.

BACKGROUND OF THE INVENTION

Such hearing devices are known in a great number of different types, whereas usually a differentiation of categories is made between around-the-ear arranged hearing devices, in-the-ear canal hearing devices and implanted hearing devices. For programmable hearing devices, the basic settings and features will be adapted by respective adjustment and/or programming according the individual requirements and needs of the user of the hearing device. This will be carried out during the fitting process taking place for several meetings of the user at the audiologist (or the hearing aids acoustician), whereby the hearing device will be adjusted or tuned.

The user usually thereby receives a fully functional hearing device with all the features enabled independent from its future application, e.g. a selective choice of functionality (pay-by-feature) or pre-paid features for a limited time period only.

A programmable hearing aid with keys for the enabling or disabling of functions, performance characteristics or programmable settings is known from DE 199 16 900. Both software and hardware keys are provided for this purpose. The functions concerned may only be used or be blocked by entering the respective key. This enables the user for testing certain functions or features of the hearing device which may afterwards rest unblocked or be blocked again. It is further proposed that the activation of such functions may only last for a predefined, limited period of time and be deactivated automatically after this time period. The main purpose of this functionality is to anticipate an improper, faulty or unauthorized use of the hearing device.

The use of such hardware keys is restricted to around-the-ear hearing devices for practical reasons due to its required space.

The application of software keys for miniaturized hearing devices is imaginable but implies always one separate key assigned to each respective individual hearing device. The storage and use of such a key makes high demands on logistic and handling. Big problems such as lost, forgotten or no longer available keys will arise especially during long maintenance rates or domicile change of the user of the hearing device that implies at least the exchange of the programmable module of the hearing device, if one or more functions or features of this module have to be unlocked or activated.

The activation or deactivation respectively of a function of the hearing device triggered by a timing counter is described in DE 199 16 900. That means that this function is actuated after a predetermined amount of time, e.g. an additional feature of the hearing device will be activated or deactivated. Such defaults on a predetermined time base are strong limitations especially during the fitting process and are too little flexible to cover multiple different requirements.

Beneath the problem of releasing several individual functions of the hearing device, an additional problem arises during the fitting process due to the common delivery of a fully functional hearing device with all functions or features enabled. This functionality of the hearing device should be activated or disabled under the control of the audiologist, in order to prevent the loss of the hearing device in its fully enabled state during the fitting process, as the user usually does not already has fully or partly paid its invoices during this period.

In view of this problem, it is an object of the present invention to provide a hearing device that permits an easy but flexible activation or deactivation of several or all of its functions or features.

SUMMARY OF THE INVENTION

The present invention thus provides a hearing device with at least one programmable signal processing unit for the temporary or permanent activation or deactivation of features of the hearing device, comprising at least one counter for the logging of discrete actions and at least one stored threshold value related to at least one specific type of said actions, the counter being connected to said signal processing unit for activating or deactivating a feature of said signal processing unit when reaching or passing said threshold value. As long as the threshold value is not reached by the counter, the hearing device will have its originally predetermined functionality or programmed features without any further limitations. If the counter reaches or passes its threshold value, an action will be triggered by the counter directed to the signal processing unit causing a predefined reaction of the hearing device. This reaction may be used as a theft protection by derogating, disturbing or disabling any functionality of the hearing device. This forces the user of the hearing device either to visit the audiologist who delivered the hearing device or to attain to a service center of the manufacturer of the hearing device, to re-establish the original functionality of the hearing device or to receive an alternate hearing device.

In one embodiment, the hearing device comprises several separate counters each assigned to one stored threshold value. Thus, not only one but several different thresholds may be defined according both the need of the audiologist and the requirements of the user, wherein the activating or deactivating of a feature by the counter will be initiated after passing the respective threshold value.

In another embodiment the counter comprises a reset function, to reset the counter after reaching its assigned threshold value. This is useful for activating a temporary function or feature, e.g. for automatically reactivating a deactivated feature after a certain time. The complete and permanent disabling of a feature or of the whole hearing device may thus be prevented, but by repeating the actions concerned and temporary disabling the feature related to this action, the user will be forced to visit the audiologist for definitely activating or disabling the feature concerned.

In another embodiment, the hearing device comprises further a reset control for resetting one, some or all counters, if activated. The reset function of one or several of the counters may be fixed wired or has its own reset circuit. Such a reset circuit or reset unit may advantageously be free programmable, e.g. to shorten the respective threshold values each time the counter reaches such a threshold value. Such a reset circuit or reset unit may be provided by a module or be a part of the hearing device software and thus be provided as a pure software solution.

In another embodiment, the reset control is connected to an on/off-Switch of the hearing device for its activation. The complete deactivation of the hearing device has been proved to be the best and efficient appliance for anti theft protection. The deactivation may be temporary, i.e. the re-establishment of the hearing device may be performed either manually by the user or automatically by the signal processing unit after a certain time period, or permanent, i.e. the hearing device will remain deactivated until reaching the audiologist or a service center of the manufacturer of the hearing device for re-establishing the functionality or repairing the hearing device.

As already stated, the reset control may be provided in form of a software solution, preferably within the signal processing unit.

In a further embodiment, the threshold value is stored in a non-volatile storage area of the hearing device. The threshold value or several values will thus remain stored in the hearing device even in case of a longer power failure or absence of the battery and may thus not be influenced by the user in a simple manner. This is especially important if the user receives long service intervals or fitting intervals, during which the battery will presumably have to be changed.

In a further embodiment, the counter is provided as a software solution within the signal processing unit of the hearing device. Thus, it is not necessary to provide own counting modules. The counter may be realized by using the built-in programmable feature of the signal processing unit.

In a further embodiment, the discrete actions for logging comprise one or several of the following actions:

- switching on or off the hearing device;
- changing the battery;
- under-run of a pre-defined voltage value of the battery;
- number of program changes of the hearing device software;
- number of feedback detections;
- number of activities in mechanical, electrical or chemical interfaces of the hearing device itself.

These are typical actions in relation with the use of a hearing device, especially during the fitting procedure of the hearing device. Those features may be as well of a certain importance for the testing of additional features that may be activated on a pay-per-feature basis. The audiologist may thus activate such features for the user of the hearing device without having a cost risk. These features may be deactivated after a limited amount of actions performed by the user for testing purposes. The audiologist may further permanently activate such a feature only after being paid by the user.

In a further embodiment, the discrete action for logging comprises the exceeding of predetermined points of time. Furthermore, the exceeding may be compared in relation to an internal timer of the hearing device or the exceeding may be compared in relation to the actual time transferred from an external device into the hearing device. Thus, the internal clock of the hearing device, if applicable, may be used or an external timing device, such as a radio controlled clock, may be used for always having the exact time.

In another embodiment, at least a part or the entire software of the hearing device is locked after activating or deactivating a feature by the counter. If only a part of the software of the hearing device is locked, the hearing device may still be used with its basic functionality (e.g. the amplifying of sound) enabling the user to still use the hearing device until the next visit to the audiologist and thus not be forced to waive the use of the hearing device. If the entire software of the hearing device is locked, the hearing device may not be used until visiting the audiologist or a service center of the manufacturer of the hearing device with the installations necessary to unlock the software again.

In a further embodiment, an additional signal blip or static noise will be generated by the hearing device after activating or deactivating a feature by the counter. Thus, the whole functionality or all features of the hearing device remains fully enabled, but the user will hear an acoustical indication about the reaching of a threshold value. This acoustical signal may further consist of a clearly spoken announcement, which allows the exact identification of the threshold concerned. In a further embodiment, the signal blip or static noise will be generated permanently, periodically or randomly.

In a further embodiment, a reduction or switching off of the amplification of the signal processing unit takes place after activating or deactivating a feature by the counter. Although the basic functionality and additional features of the hearing device remains active, the usability of the hearing device for the user will be importantly limited, e.g. only providing a limited amount of hearing situations or only a single hearing situation.

In a further embodiment, one or more lead fuses are burned through after activating or deactivating a feature by the counter. This will cause a permanent deactivation of one, several or all features of the hearing device that will only be reactivated after repairing the hearing device by the audiologist or the service center by replacing the fuse concerned.

In another embodiment the activation or deactivation of a feature by the counter remains permanent or only temporary. In case of temporary activation or deactivation of features, the hearing device reinstates its former state and may thus be used as before without any action by the user or the audiologist or service center. A permanent activation or deactivation of features will remain obvious for the audiologist or the service center, e.g. by storing identifying information in the non-volatile memory of the hearing device, which can be read out by the audiologist or service center.

It is pointed out that the present invention not only relies to hearing devices such as behind-the-ear, in-the-ear canal or implanted hearing aids for the compensation or correction of a hearing impairment. The present invention may be applied as well for any hearing device used to improve communication.

DESCRIPTION OF THE DRAWINGS

For purpose of facilitating and understanding of the invention, there is illustrated in the accompanying drawing a preferred embodiment thereof to be considered in connection with the following description. Thus the invention may be readily understood and appreciated by the only figure showing a schematically plan of an embodiment of the present invention.

DESCRIPTION OF A PREFFERED EMBODIMENT

Figure 1:
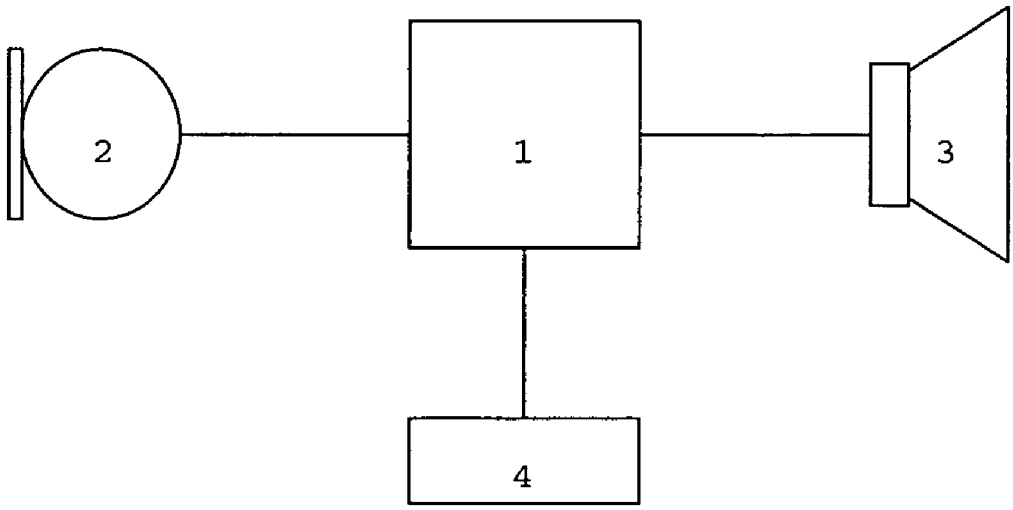

Referring to FIG. 1, the schematically plan of an embodiment of a hearing device is shown. A signal processing unit 1 is connected with a microphone 2 and a speaker 3. The sound received by the microphone 2 will be processed by the signal processing unit 1 and subsequently emitted through the speaker 3. The figure is a pure schematical and strongly simplified plan of the basic process of the recording and amplifying of audio signals of hearing devices.

The signal processing units 1 are commonly provided in form of programmable modules which may be adapted to the individual needs and requirements of the hearing device users to achieve an optimum benefit. Such a hearing device will not only be used to compensate or correct a hearing impairment of the user, but as well for the improvement or support of any audio communication.

A counter 4 is inventively provided to act onto the signal processing unit 1 to influence the functionality of this signal processing unit 1. This acting will always take place if the counter 4 reaches or passes a determined threshold value.

The counter 4 may be provided in form of a separate electronic module or as a programmable module in form of a software counter or as a pure software solution, e.g. within the signal processing unit 1.

Any quantifiable actions in or around the hearing device may be used as input for or detected by the counter 4 and compared with an assigned stored threshold value. Those threshold values may be defined individually for any hearing device and for instance be stored in the non-volatile memory of the hearing device. Thus enabling an individual control to the action directed onto the signal processing unit 1 and therefore to the functionality of this signal processing unit 1, that may be used as a specific theft control for instance.

The switching on or off of this basic functionality, e.g. the activation or deactivation of one or multiple counters 4, will preferably be performed by a service center or by the audiologist. The common fitting software for the fitting process of programmable hearing devices may be used for this purpose. The activation or deactivation of such counters 4 by the fitting software may additionally be secured with a password.

It is thus possible to deliver hearing devices for testing or demonstration purposes, whereby its functionality or features will be fully disabled after a predefined amount of on/off switching actions for instance. A great rate of return of such demonstration hearing devices may therefore be expected, as those hearing devices may not be used any longer after disabling of its whole functionality.

As a further advantage, the influence of the counter 4 to the signal processing unit 1 may be temporary or permanent. In case of a permanent influence the functionality or feature concerned of the hearing device will be permanently restricted or disabled. This may be achieved for instance by a permanent destruction of components of the hearing device, such as the burning through of lead fuses of the hearing device. The hearing device has subsequently to be repaired by a service center for recovering its original functionality.

A permanent identification of the reaching or passing of a threshold value of a counter 4 may be achieved by storing a respective identifier or code within the non-volatile memory of the hearing device. The audiologist or service center may afterwards detect such an occurrence by reading out the non-volatile memory.

The restricted functionality of the hearing device caused by a temporary influence by the counter 4 onto the signal processing unit 1 may be for instance revoked by the user itself. This may be carried out for instance by switching off and on of the hearing device or by activating a switch intended for this purpose. Such a switch may be located at the hearing device itself or be simulated by use of a remote control for the hearing device.

A temporary action by the counter 4 must not have a direct influence onto the functionality of the hearing device, but may activate an acoustic signal or transmit spoken acoustic information by the speaker 3 to the user, indicating the reaching or passing of a threshold. The functionality or features of the hearing device will thus not be influenced, thereby not affecting the overall comfort or use of the hearing device for the user, but the acoustic signals will be uncomfortable for the continuous use of the hearing device.

The threshold value may be altered with respect to the number of reaching this threshold value. The threshold value may for instance be sequentially diminished after each reaching or passing of said threshold value by the counter 4. The related function or feature of the hearing device will then be permanently disabled after having repeatedly passed the threshold value concerned.

The present hearing device enables the audiologist and eventually the service center to provide a hearing device with its full functionality during the fitting process and to offer eventually test or demonstration devices ensuring their legitimated economical interests. On the other hand, a strong impairment for the user due to not activated functions or features may thus be prevented and the restrictions caused after reaching or passing the thresholds may be easy removed by the audiologist or the service center.

It is clear for the man skilled in the art that the counter 4 according the plan of FIG. 1 may be integrated directly within the signal processing unit 1, and that several counters 4 may be used parallel or independent from each other.

The invention claimed is:

1. Hearing device with at least one programmable signal processing unit (1) for the temporary or permanent activation or deactivation of features of the hearing device, comprising at least one counter (4) for the logging of discrete actions and at least one stored threshold value related to at least one specific type of said actions, the counter (4) being connected to said signal processing unit (1) for activating or deactivating a feature of said signal processing unit (1) when reaching or passing said threshold value, wherein a part of, but not the entire, software of the hearing device is locked after activating or deactivating the feature by the counter (4), and the hearing device amplifies and outputs sound after the software is locked.

2. Hearing device according claim 1, wherein the at least one counter is several separate counters (4) each assigned to one stored threshold value.

3. Hearing device according claim 1 wherein the counter (4) comprises a reset function, to reset the counter (4) after reaching its assigned threshold value.

4. Hearing device according claim 1 comprising further a reset control for resetting one, some or all counters (4) if activated.

5. Hearing device according claim 4 wherein the reset control is connected to an on/off-Switch of the hearing device for its activation.

6. Hearing device according claim 4 wherein the reset control is provided in form of a software solution.

7. Hearing device according claim 6 wherein the reset control is provided within the signal processing unit.

8. Hearing device according to claim 1 wherein the threshold value is stored in a non-volatile storage area of the hearing device.

9. Hearing device according to claim 1 wherein the counter (4) is provided as a software solution within the signal processing unit of the hearing device.

10. Hearing device according to claim 1 wherein the discrete actions for logging comprise one or several of the following actions:

switching on or off the hearing device;

changing the battery;

under-run of a pre-defined voltage value of the battery;

number of program changes of the hearing device software;

number of feedback detections;

number of activities in mechanical, electrical or chemical interfaces of the hearing device itself.

11. Hearing device according to claim 1 wherein the discrete action for logging comprises the exceeding of predetermined points of time.

12. Hearing device according claim 11 wherein the exceeding is compared in relation to an internal timer of the hearing device.

13. Hearing device according claim 11 wherein the exceeding is compared in relation to the actual time transferred from an external device into the hearing device.

14. Hearing device according to claim 1 wherein an additional signal blip or static noise is generated by the hearing device after activating or deactivating a feature by the counter (4).

15. Hearing device according claim 14 wherein the signal blip or static noise is generated permanently, periodically or randomly.

16. Hearing device according to claim 1 wherein a reduction of the amplification of the signal processing unit (1) takes place after activating or deactivating a feature by the counter (4).

17. Hearing device according to claim 1 wherein one or more lead fuses are burned through after activating or deactivating a feature by the counter (4).

18. Hearing device according to claim 1 wherein the activation or deactivation of a feature by the counter (4) remains permanent or only temporary.

* * * * *